US006228221B1

(12) United States Patent
Loser et al.

(10) Patent No.: US 6,228,221 B1
(45) Date of Patent: May 8, 2001

(54) DEWATERING PRESS AND PROCESS

(75) Inventors: Hans Loser, Langenau; Joachim Henssler, Ravensburg; Karl Steiner, Herbrechtingen, all of (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 08/985,270

(22) Filed: Dec. 4, 1997

(30) Foreign Application Priority Data

Dec. 5, 1996 (DE) ..... 196 50 396

(51) Int. Cl.[7] ..... D21F 3/06
(52) U.S. Cl. ..... 162/205; 162/198; 162/358.3
(58) Field of Search ..... 162/358.1, 358.2, 162/358.3, 358.4, 360.2, 361, 205, 198

(56) References Cited

U.S. PATENT DOCUMENTS

| | | | | |
|---|---|---|---|---|
| 4,576,682 | * | 3/1986 | Laapotti | 162/358 |
| 4,738,752 | | 4/1988 | Busker et al. . | |
| 5,071,513 | | 12/1991 | Bluhm et al. . | |
| 5,522,959 | | 6/1996 | Ilmarinen . | |
| 5,639,351 | | 6/1997 | Ilmarinen . | |
| 5,865,954 | * | 2/1999 | Laapotti | 162/205 |

FOREIGN PATENT DOCUMENTS

| | | |
|---|---|---|
| 2262201 | 7/1973 | (DE) . |
| 3410172 | 9/1984 | (DE) . |
| 0258169 | 3/1988 | (EP) . |
| 0549553 | 6/1993 | (EP) . |
| 0859081 | 8/1998 | (EP) . |
| 93/23613 | 11/1993 | (WO) . |

OTHER PUBLICATIONS

Mirsberger, "Schuhpressen zum intensiven Entwässern von Papier und Karton," *Das Papier*, 43 Jg., H. 10A, pp. 130–138 (1989), i.e., the literature listed on p. 1 (of the German Search Report).

Copy of a German Search Report dated May 20, 1997 prepared in connection with German Patent Application No. 196 50 396.5.

* cited by examiner

*Primary Examiner*—Peter Chin
(74) *Attorney, Agent, or Firm*—Greenblum & Bernstein, P.L.C.

(57) ABSTRACT

Process for dewatering a fibrous web in a dewatering press including a counterpart face, a shoe press unit having a revolving flexible press belt and at least one press shoe such that the at least one press shoe is arranged to press the flexible press belt against the counterpart face, at least one nip formed by the flexible press belt being pressed against the counterpart face having a length extending in a web travel direction and being at least substantially similar to a length of the at least one press shoe in the web travel direction, and a device that guides the fibrous web and at least one dewatering belt being guided through the extended nip. The process may include pressing the fibrous web within the extended nip, determining a dwell time of the fibrous web within the extended nip, and maintaining the dwell time at less than approximately 12 ms. The dewatering press may include a counterpart face and a shoe press unit that includes a revolving flexible press belt and at least one press shoe. The at least one press shoe may be arranged to press the flexible press belt against the counterpart face. At least one nip may be formed by the flexible press belt being pressed against the counterpart face and may have a length extended in a web travel direction. The extended nip length in the web travel direction may be at least substantially similar to a length of the at least one press shoe in the web travel direction, and the fibrous web and at least one dewatering belt may be guided through the extended nip. The dewatering press may be arranged to provide a dwell time of the fibrous web being within the extended nip of less than approximately 12 ms.

9 Claims, 2 Drawing Sheets

DEWATERING PRESS AND PROCESS

CROSS-REFERENCE OF RELATED APPLICATION

The present invention claims the priority under 35 U.S.C. §119 of German Patent Application No. 196 50 396.5 filed on Dec. 5, 1996, the disclosure of which is expressly incorporated by reference herein in its entirety.

BACKGROUND OF THE INVENTION

1. Field of the Invention

The present invention relates to a dewatering press of a machine for producing a fibrous web, e.g., a web of paper or cardboard. The dewatering press may include at least one extended nip, lengthened in the web travel direction, formed between a rotating or revolving flexible press belt of a shoe press unit and a counterpart face. The flexible press belt can be pressed against the counterpart face by at least one press shoe associated with the shoe press unit. A length of the extended nip may be determined at least substantially by a length of the press shoe length, measured in the web travel direction, of the shoe press unit. The fibrous web may be guided through the extended nip with at least one dewatering belt through the lengthened nip.

2. Discussion of Background Information

Dewatering presses similar in general to the device described have been in use for some time, and have been discussed in, e.g., German patent DE-PS 22 62 201, German patent DE-PS 34 10 172, and European Patent EP 258 169. In devices of this type, the result of the dewatering has been improved by utilizing a long dwell time of the fibrous web in the extended nip. However, because the extended nips utilize increasing pressure pressing surfaces, increasing contact pressure forces are required to ensure a certain or reliable pressing power. Thus, the prior art devices require substantial technological effort and, accordingly, considerable costs as well.

SUMMARY OF THE INVENTION

According to the present invention, the above-described extended nip press utilizes a dwell time $t_w$ of the fibrous web in the extended nip of less than 12 ms. As a result of the recognition that within a dwell time of approximately 12 ms, and in particular even approximately 6 ms, most of the possible dewatering performance is achieved, the present invention makes it possible to limit the length of the extended nip and, therefore, limit the length of the press shoe in the web travel direction. In general, dwell time $t_w$ is determined by the extended nip length and the speed of the fibrous web.

Because a minimal pressing power (pressure) must be available for dewatering operation, i.e., to press the water out of the fibrous web and into the dewatering belt, optimizing the press shoe length enables a minimization of the contact-pressure force that must be brought to bear by the shoe press unit.

For effective dewatering in general, the present invention utilizes a minimum pressing power (pressure) established in accordance with the dry content of the fibrous web. That is, the minimum pressing power in the extended nip is determined or set to be $(T_{abs}\times100)^3$ N/m$^2$, where $T_{abs}$ represents absolute dry content at the beginning of the extended nip. For example, for an initial dry content of 20%, $T_{abs}$=0.2 and a pressing power of more than 8000 N/m$^2$ is required. In an alternative, a minimum pressing power may be preestablished to be 500 KN/m$^2$.

However, to achieve acceptable dewatering performance in the nip, a minimal dwell time must naturally also be ensured. In accordance with the present invention, the minimal dwell time is approximately 2 ms, and preferably approximately 4 ms.

According to the features of the present invention, there are a number of ways in which the extended nip may be formed. Further, one or more dewatering belts may be guided through the nip with the web. For example, the extended nip may be formed by a flexible press belt of a shoe press unit being pressed against a cylindrical roll, and, under some circumstances, with controlled sagging. In another example, the press shoe of the shoe press unit may have a concave contact-pressure face. In a further example, the extended nip may be formed by two shoe press units, in which the contact-pressure faces are preferably formed as flat.

In addition, the press shoe of one or more shoe press units may include a plurality of smaller press shoes axially disposed and/or positioned side by side in the web travel direction. Further, at least some of the smaller press shoes may be provided to be independently pressable with respect to one another.

For ascertaining the nip length and thus the dwell time, in particular the portion or portions of the nip in which the pressing power is greater than $(T_{abs}\times100)^3$N/m$^2$ and in particular greater than 500 KN/m$^2$ are determinative.

The present invention is directed to a process of dewatering a fibrous web in a dewatering press that includes a counterpart face, a shoe press unit having a revolving flexible press belt and at least one press shoe such that the at least one press shoe is arranged to press the flexible press belt against the counterpart face, at least one nip formed by the flexible press belt being pressed against the counterpart face having a length extending in a web travel direction and being at least substantially similar to a length of the at least one press shoe in the web travel direction, and a device that guides the fibrous web and at least one dewatering belt being guided through the extended nip. The process may include pressing the fibrous web within the extended nip, determining a dwell time of the fibrous web within the extended nip, and maintaining the dwell time at less than approximately 12 ms.

In accordance with a further feature of the present invention, the process may further include maintaining the dwell time at less than approximately 6 ms. Further, the process may include maintaining the dwell time at greater than approximately 2 ms, and preferably, maintaining the dwell time at greater than approximately 4 ms.

In accordance with still another feature of the present invention, the determining of the dwell time may include establishing a minimum pressure, determining a length of the extended nip in accordance with one of a portion and a plurality of portions of the extended nip in which greater than the minimum pressure power is exerted, determining a speed of the fibrous web through the extended nip, and calculating the dwell time from the determined length of the extended nip divided by the determined speed of the fibrous web. Further, the establishing of the minimum power pressure may include selecting the minimum power pressure of approximately 500 KN/m$^2$. Alternatively, the establishing of the minimum pressure may include selecting the minimum pressure in accordance with an absolute dry content of the fibrous web preceding the extended nip. In this regard, the selecting of the minimum pressure may be selected in accordance with the formula $P_{min}=(T_{abs}\times100)^3$N/m$^2$, where $P_{min}$ represents the minimum pressure and $T_{abs}$ represents the absolute dry content of the fibrous web at an inlet of the extended nip.

In accordance with a further feature of the present invention, the speed of the fibrous web may be between approximately 600 and 1500 m/min.

In accordance with a still further feature of the present invention, the length of the extended nip may be between approximately 25 and 35 cm.

In accordance with yet another feature of the present invention, the absolute dry content of the fibrous web may be between approximately 0.20 and 0.60 at an inlet of the extended nip.

The present invention is also directed to a dewatering press of a machine for producing a fibrous web. The dewatering press may include a counterpart face and a shoe press unit that includes a revolving flexible press belt and at least one press shoe. The at least one press shoe may be arranged to press the flexible press belt against the counterpart face. At least one nip may be formed by the flexible press belt being pressed against the counterpart face and may have a length extended in a web travel direction. The extended nip length in the web travel direction may be at least substantially similar to a length of the at least one press shoe in the web travel direction. The dewatering press may also include a device that moves the fibrous web and at least one dewatering belt through the extended nip to provide a dwell time of the fibrous web being within the extended nip of less than approximately 12 ms.

In accordance with another feature of the present invention, the dwell time may be less than approximately 6 ms. The dwell time may also be greater than approximately 2 ms, and preferably greater than approximately 4 ms.

In accordance with still another feature of the present invention, the dewatering press may also include a counter roll that includes the counterpart face and the at least one press shoe may include a concave contact-pressure face. Alternatively, the dewatering press may include a second shoe press unit that includes the counterpart face and the at least one press shoe may include a substantially flat contact-pressure face.

In accordance with a further feature of the present invention, the at least one press shoe may include a plurality of press shoes at least one of axially arranged and positioned side by side in the web travel direction. Further, at least some of the plurality of press shoes may be independently pressable with respect to each other.

In accordance with another feature of the present invention, the extended nip length may be determinable from a length in the web travel direction of one of a portion and a plurality of portions within of the extended nip under a pressing power greater than an a minimum pressing power. The minimum pressing power ($P_{min}$) may be determined by the formula $P_{min}=(T_{abs}\times 100)^3 N/m^2$. $T_{abs}$ may represent an absolute dry content of the fibrous web at a beginning of the nip.

In accordance with still another feature of the present invention, the extended nip length may be determinable from a length in the web travel direction of one of a portion and a plurality of portions within of the extended nip under a pressing power greater than approximately 500 $KN/m^2$.

In accordance with a still further feature of the present invention, the fibrous web may include a web composed of one of paper and cardboard.

In accordance with still another feature of the present invention, at least one of the length of the extended press nip and a speed of the fibrous web may be adjustable to regulate the dwell time. Further, the length of the extended press nip may be adjustable in accordance with a length of at least one portion extending in the web travel direction in which a pressure greater than approximately 500 $KN/m^2$ is exerted. Alternatively, the length of the extended press nip may be adjustable in accordance with a length of at least one portion extending in the web travel direction in which a pressure power greater than $(T_{abs}\times 100)^3 N/m^2$ is exerted.

The present invention may be directed to a dewatering press of a machine for producing a fibrous web. The dewatering press may include a counterpart face and a shoe press unit that includes a revolving flexible press belt and at least one press shoe. The at least one press shoe may be arranged to press the flexible press belt against the counterpart face. At least one nip formed by the flexible press belt may be pressed against the counterpart face and may have a length extended in a belt travel direction. The extended nip length in the belt travel direction may be at least substantially similar to a length of the at least one press shoe in the web travel direction and at least one dewatering belt may be guided through the extended nip. The dewatering press may also include a device that drive the press belt and the at least one dewatering belt to provide a dwell time of the fibrous web within the extended nip of less than approximately 12 ms.

Further embodiments and advantages can be seen from the detailed description of the present invention and the accompanying figures.

BRIEF DESCRIPTION OF THE DRAWINGS

The present invention is further described in the detailed description which follows, in reference to the noted drawing by way of non-limiting examples of preferred embodiments of the present invention, wherein same reference numerals represent similar parts throughout the several views of the drawings, and wherein.

DETAILED DESCRIPTION OF THE INVENTION

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
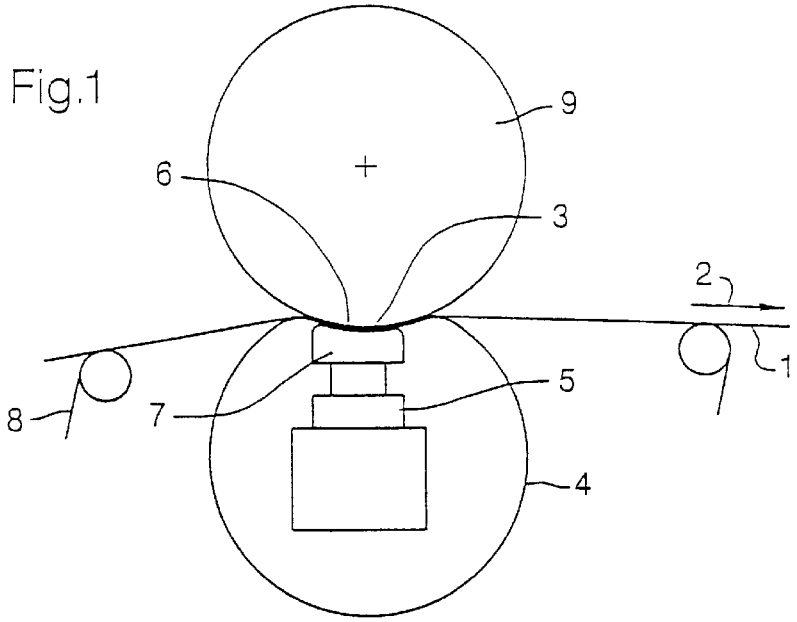
FIG. 1 illustrates a an extended nip formed between one press shoe of a shoe press unit and a cylindrical counter roll.
Figure 2:
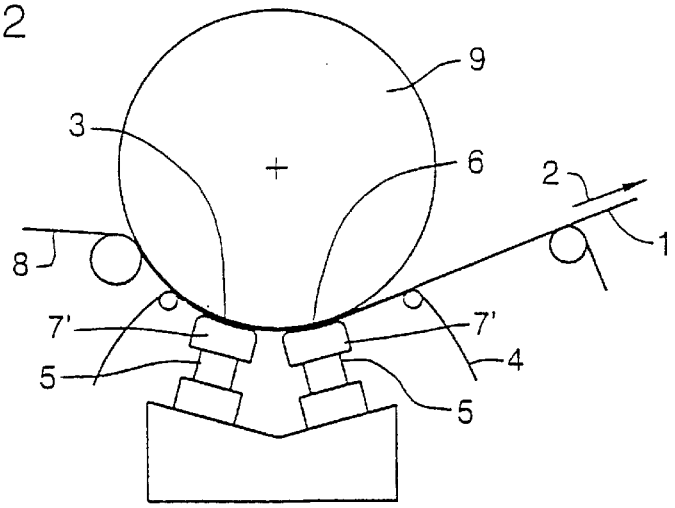
FIG. 2 illustrates an extended nip 3 formed between two press shoes of a shoe press unit and a cylindrical counter roll.
Figure 3:
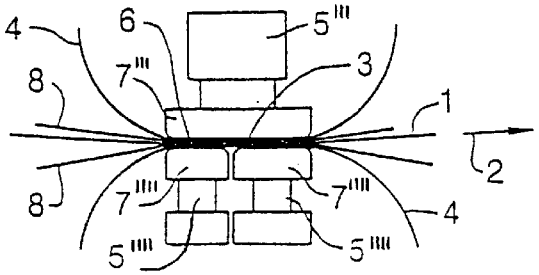
FIG. 3 illustrates an extended nip 3 formed between two press shoes of a shoe press unit and one press shoe of another shoe press unit.

In each of the embodiments depicted in FIGS. 1–3, the dewatering press comprises at least one nip 3 having an extended length in a web travel direction 2. Extended nip 3 is formed between a revolving flexible, substantially water-impermeable press belt 4 of a shoe press unit 5 and a counterpart face 6 of a counter roll 9. Flexible press belt 4 may be pressed against counterpart face 6 by at least one press shoe 7 or 7' associated with the shoe press unit 5. The extended nip length $l_p$ may be determined as substantially the same as the press shoe length of shoe press unit 5, i.e., measured in web travel direction 2. Further, fibrous web 1 may be guided through extended nip 3 with at least one water-absorbent dewatering belt 8.

The specific structural configuration of shoe press units 5 and counter roll 9 are generally known, e.g., as presented in the documents discussed in the background section of the present application. The contact pressure of press shoes 7 or 7' against the interior of flexible belt 4 against counterpart face 6 may be provided, e.g., hydraulically. The lubrication between press shoes 7 or 7' and the interior surface of press belt 4 may be provided, e.g., at least one of hydrodynamically and hydrostatically.

In FIG. 1, press shoe 7 of shoe press unit 5 may be provided with a concave contact-pressure face that presses press belt 4 against counterpart face 6 of cylindrical counter roll 9 to form extended nip 3. In FIG. 2, shoe press unit may include two shoe press units 5', each having a press shoe 7', e.g., smaller than press shoe 7 depicted in FIG. 1, that may be spaced apart from one another in web travel direction 2 to controllably press press belt 4 against counterpart face 6. Press shoes 7' may be controllably press press belt 4 independently of each other. FIG. 3 illustrates a substantially flat formed extended nip 3 formed between two shoe press units 5''' and 5''''. Shoe press unit 5''' may include a press shoe 7''' that includes a substantially flat contact face, and the opposite shoe press unit may include at least two shoe press units 5'''', each including a press shoe 7'''' having a substantially flat contact face and spaced apart in web travel direction 2. Press shoes 7'''' may be smaller in size than press shoe 7 such that press shoes 7'''' extend a length in web travel direction 2 that is substantially the same as the length of press shoe 7'''. A flexible, endless, substantially water-impermeable press belt 4 may be guided over press shoes 7''' and 7''''. The pressure may be applied and monitored by any suitable device or devices known in the art.

In FIGS. 1 and 2, a water-absorbent dewatering belt 8, e.g., a felt, may be guided through extended nip 3 with press belt 4 and fibrous web 1. Alternatively, as shown in FIG. 3, a water-absorbent dewatering belt 8 may be guided through extended nip 3 such that fibrous web 1 is positioned between dewatering belts 8. However, the above-noted arrangements are intended merely for the purposes of explanation, the specific arrangements may be devised by the ordinarily skilled artisan using the features of the present invention and considering various factors, including, e.g., type of paper and dry content of fibrous web 1. As is generally known in the prior art, presses of the type generally described above conventionally utilize speeds (v) of, e.g., between approximately 600 to 1500 m/min, and utilized press shoes having lengths of, e.g., between approximately 25 to 35 cm. However, as discussed above, the wider press shoes 7, which are generally used at the higher speeds (v), may lead to the above-noted disadvantages.

The present invention has recognized that the greatest part of a dewatering operation may be completed within a dwell time $t_w$ of fibrous web 1 in extended nip 3 of less than approximately 12 ms, and, in particular, of approximately 6 ms. In recognizing this, the present invention may minimize nip length $l_p$, which also leads to a minimization of the contact-pressure force of shoe press unit 5. Thus, the present invention provides, not only energy savings, but a reduction in cost due to the simplified structural layout of the shoe press unit 5.

However, the present invention also recognizes that a minimal dwell time of, e.g., approximately 2 ms, and, in particular, approximately 4 ms, may be necessary if sufficiently extensive dewatering performance is to be achieved.

Figure 5:
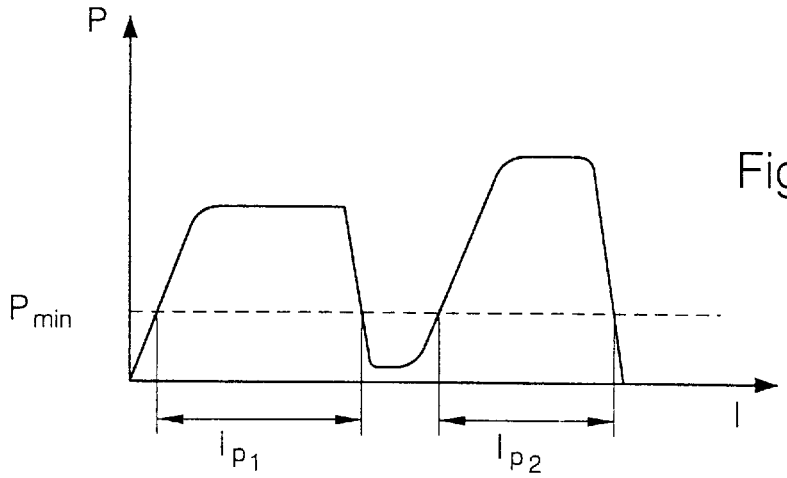
FIG. 5 illustrates a graphical plot of the pressure exerted in the extended press nip depicted in FIG. 2.

Whenever press shoe 7 of shoe press unit 5, e.g., as shown in FIGS. 2 and 3, include a plurality of smaller press shoes 7' disposed side by side in web travel direction 2 a more precise determination of nip length $l_p$ may be necessary and/or advantageous. This may be due to the fact that the plurality of press shoes presents the possibly of very deep pressure sinks, as shown in FIG. 5, being present between the press shoes, or that the plurality of press shoes 7 may form pressure sinks in web travel direction 2 or have a lesser pressure gradient at an inlet and/or an outlet of extended nip 3.

Figure 4:
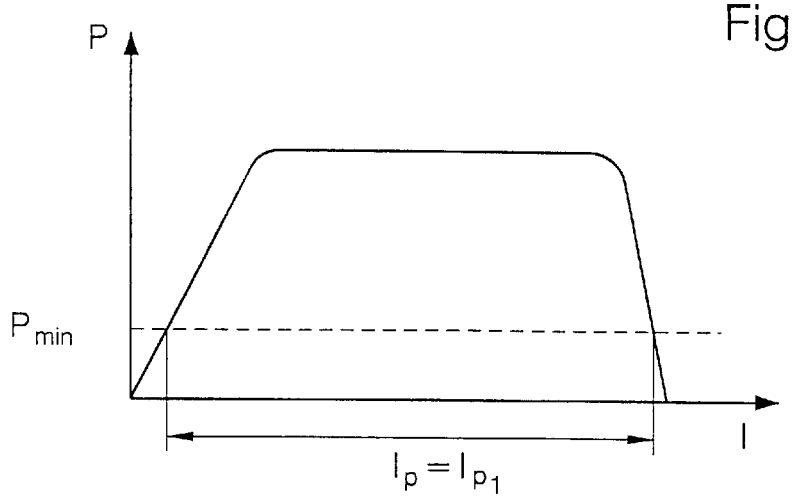
FIG. 4 illustrates a graphical plot of the pressure exerted in the extended press nip depicted in FIG. 1.
Figure 6:
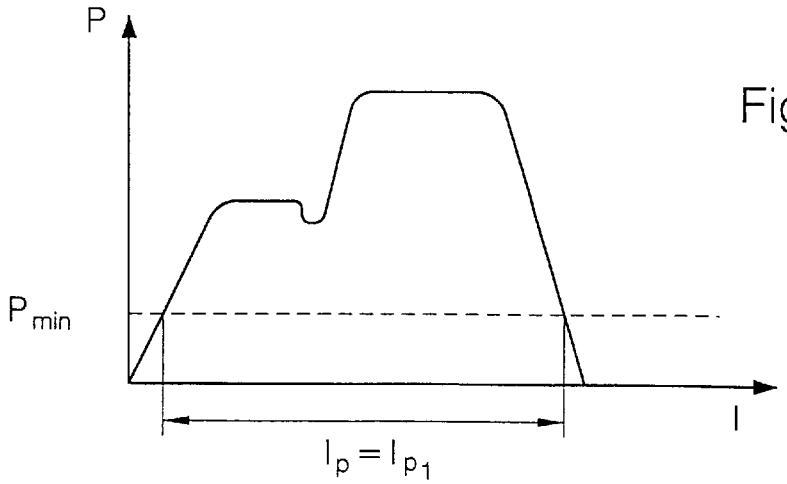
FIG. 6 illustrates a graphical plot of the pressure exerted in the extended press nip depicted in FIG. 3.

The present invention has also recognized that effective dewatering of a fibrous web is not accomplished until a pressing power (pressure) P greater than $P_{min}=(T_{abs}\times 100)^3 N/m^2$ is exerted in extended nip 3, where $T_{abs}$ represents an absolute dry content of the fibrous web at the beginning of extended nip 3. As shown in FIGS. 4–6, exemplary plots for the pressing power versus the extended nip length is shown for each of the exemplary embodiments 1–3, respectively. To calculate dwell time $t_w$ in accordance with the present invention, the length $l_{p1}$, or lengths $l_{p1}$ and $l_{p2}$, of extended nip 3 that exhibit a pressing power above $P_{min}$ should be calculated from $l_p=l_{p1}+l_{p2}$. In this manner, dwell time may be calculated from the following:

$$t_w=l_p/v=(l_{p1}+l_{p2})/v$$

in which v is the speed of the web through extended nip 3. The minimum pressing power, the length of the extended nip, the web speed, and the dwell time may be, e.g., determined and calculated prior to beginning the dewatering process and the process may utilize the determined or calculated values until changed by the user.

The dry content of fibrous web 1 may be generally between approximately 0.2 and 0.6 at an inlet of extended nip 3. It may also be advantageous if nip length $l_p$ is determined by those portions $l_{p1}$, $l_{p2}$ of press shoe 7 in which the pressing power P is greater than a preset $P_{min}=500$ $KN/m^2$.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A process of dewatering a fibrous web in a dewatering press including a counterpart face, a shoe press unit having a revolving flexible press belt and at least one press shoe such that the at least one press shoe is arranged to press the flexible press belt against the counterpart face, at least one nip formed by the flexible press belt being pressed against the counterpart face and having a length extending in a web travel direction and being at least substantially similar to a length of the at least one press shoe in the web travel direction, and a device that guides the fibrous web and at least one dewatering belt being guided through the extended nip, the process comprising:

pressing the fibrous web within the extended nip;

determining a dwell time of the pressing of the fibrous web within the extended nip, wherein the dwell time is less than approximately 12 ms; and maintaining the determined dwell time, wherein the determining of the dwell time comprises:

establishing a minimum pressure in accordance with the formula:

$P_{min}=(T_{abs}\times 100)^3 N/m^2$, wherein $P_{min}$ represents the minimum pressure, and $T_{abs}$ represents the absolute dry content of the fibrous web at an inlet of the extended nip;

determining a length of the extended nip in accordance with a total length of one of a portion of and a plurality of portions of the extended nip in which a pressure greater than the minimum pressure is exerted;

determining a speed of the fibrous web through the extended nip; and calculating the dwell time from the determined length of the extended nip divided by the determined speed of the fibrous web.

2. The process according to claim 1, further comprising maintaining the dwell time at less than approximately 6 ms.

3. The process according to claim 1, further comprising maintaining the dwell time at greater than approximately 2 ms.

4. The process according to claim 1, further comprising maintaining the dwell time at greater than approximately 4 ms.

5. The process according to claim 1, wherein the minimum pressure is approximately 500 KN/m2.

6. The process according to claim 1, wherein the minimum pressure is established in accordance with an absolute dry content of the fibrous web preceding the extended nip.

7. The process according to claim 1, the speed of the fibrous web being between approximately 600 and 1500 m/min.

8. The process according to claim 1, the length of the extended nip being between approximately 25 and 35 cm.

9. The process according to claim 1, wherein the absolute dry content of the fibrous web is between approximately 0.20 and 0.60 at an inlet of the extended nip.

* * * * *